US011214461B2

(12) United States Patent
Stinson

(10) Patent No.: US 11,214,461 B2
(45) Date of Patent: Jan. 4, 2022

(54) SLIP RESISTANT CORE FOR HOLDING A PAPER WEB

(71) Applicant: GPCP IP Holdings LLC, Atlanta, GA (US)

(72) Inventor: John F. Stinson, Baton Rouge, LA (US)

(73) Assignee: GPCP IP Holdings LLC, Atlanta, GA (US)

( * ) Notice: Subject to any disclaimer, the term of this patent is extended or adjusted under 35 U.S.C. 154(b) by 189 days.

(21) Appl. No.: 15/061,103

(22) Filed: Mar. 4, 2016

(65) Prior Publication Data

US 2016/0280505 A1 Sep. 29, 2016

Related U.S. Application Data

(60) Provisional application No. 62/137,900, filed on Mar. 25, 2015.

(51) Int. Cl.
*B65H 75/26* (2006.01)
*B65H 75/10* (2006.01)

(52) U.S. Cl.
CPC ..... *B65H 75/26* (2013.01); *B65H 75/10* (2013.01); *B65H 2801/84* (2013.01)

(58) Field of Classification Search
CPC ..... B65H 75/26; B65H 75/10; B65H 75/50; B65H 2701/5112; B65H 2801/84
See application file for complete search history.

(56) References Cited

U.S. PATENT DOCUMENTS 2,327,738 A * 8/1943 Perry ..... B65H 75/26 242/118.32
2,765,129 A * 10/1956 Dunlap ..... B65H 75/18 236/9 R
2,916,226 A * 12/1959 McGraw Jr. ..... B65H 75/08 242/610.4
3,503,567 A 3/1970 Casey
3,522,700 A * 8/1970 Fisher, Jr. ..... B65H 75/24 242/118.2
3,544,034 A * 12/1970 Roediger ..... B65H 75/26 242/118.32

(Continued)

FOREIGN PATENT DOCUMENTS

DE 3105828 A1 9/1982
EP 0613849 A1 9/1994

(Continued)

OTHER PUBLICATIONS

International Preliminary Report on Patentability, dated Jul. 28, 2017 relating to PCT/US2016/022751.

(Continued)

*Primary Examiner* — William A. Rivera
(74) *Attorney, Agent, or Firm* — Laura L. Bozek

(57) ABSTRACT

The present disclosure is directed to a core-roll that contains areas of anti-slip material and methods of making the core-roll. The core-roll has one or more anti-slip zones to allow a continuous paper web to be wound around the core without the need for additional physical restraint to keep the paper from shifting laterally along the core. In another embodiment, the disclosure describes a parent roll having an anti-slip core-roll that does not interfere with other operations that occur during converting.

17 Claims, 3 Drawing Sheets

(56) References Cited

U.S. PATENT DOCUMENTS

| | | | | |
|---|---|---|---|---|
| 3,737,030 | A * | 6/1973 | Stewart | B65D 85/672 242/160.1 |
| 3,917,185 | A * | 11/1975 | Canada | B65H 75/02 242/610.6 |
| 3,989,202 | A * | 11/1976 | Noe | B65H 75/245 242/571.8 |
| 4,184,652 | A | 1/1980 | Rovin | |
| 4,649,693 | A | 3/1987 | Yeager | |
| 4,934,622 | A * | 6/1990 | Hakiel | B65H 75/10 242/160.4 |
| 5,441,212 | A * | 8/1995 | Dicken | B21C 47/28 242/532 |
| 5,478,619 | A | 12/1995 | Fujikura et al. | |
| 5,816,525 | A | 10/1998 | De et al. | |
| 5,857,643 | A | 1/1999 | Czuprynski et al. | |
| 5,875,983 | A | 3/1999 | Stuckey et al. | |
| 5,908,173 | A | 6/1999 | De et al. | |
| 6,042,048 | A | 3/2000 | Czuprynski et al. | |
| 6,820,831 | B2 | 11/2004 | Yamasaki | |
| 6,846,277 | B2 | 1/2005 | Lehner-Dittenberger | |
| 6,954,606 | B2 | 10/2005 | Pargett et al. | |
| 7,527,586 | B2 * | 5/2009 | Rummage | B31C 3/00 242/118.32 |
| 7,799,171 | B2 | 9/2010 | Mäenpää et al. | |
| 2006/0027698 | A1 | 2/2006 | Craig | |
| 2008/0156927 | A1 | 7/2008 | Rummage et al. | |
| 2009/0114754 | A1 | 5/2009 | Hopstaken et al. | |
| 2010/0087303 | A1 * | 4/2010 | Pietikainen | B31C 3/00 492/53 |
| 2013/0248643 | A1 | 9/2013 | Newhouse et al. | |
| 2018/0099835 | A1 * | 4/2018 | Couchey | B65H 75/28 |

FOREIGN PATENT DOCUMENTS

| | | | |
|---|---|---|---|
| EP | 2295356 | B1 | 7/2013 |
| GB | 1180760 | A | 2/1970 |
| WO | 2013174908 | A2 | 11/2013 |
| WO | 2015172932 | A1 | 11/2015 |

OTHER PUBLICATIONS

International Search Report and Written Opinion of the International Searching Authority that dated May 6, 2016 in PCT/US2016/022751.

Menges Roller CO, Roll Cover Products and services. Published Sep. 17, 2013. Retrieved from the internet Mar. 23, 2017 URL< http://mengesroller.com/wp-content/uploads/2014/12/Rubber-Rollers-Covered-Rollers-Brochure-Menges-Roller.pdf, 6 pgs.

Written Opinion issued in corresponding application No. PCT/US2016/022751, dated Mar. 30, 2017, 4 pgs.

* cited by examiner

SLIP RESISTANT CORE FOR HOLDING A PAPER WEB

CROSS REFERENCE TO RELATED APPLICATION

This application is based on U.S. Provisional Patent Application No. 62/137,900, filed Mar. 25, 2015, which is incorporated herein by reference in its entirety.

TECHNICAL FIELD

The present disclosure relates generally to a core-roll for use in a paper roll that minimizes slippage of the rolled paper product along the core-roll. The core-roll of the instant disclosure is particularly useful when transferring a paper web from one roll to another during converting. More specifically, a parent roll is provided with an anti-slip coating on the surface of its core-roll. Still more specifically, a core-roll is provided that includes zones that are rendered anti-slip. The anti-slip zones hold the paper web and minimize lateral shifting. According to one embodiment, anti-slip zones are chosen so as not to interfere with the subsequent operations that are applied to the paper roll and core-roll during converting.

BACKGROUND

In the production of paper goods, a fibrous web is produced from fiber that has been liberated from a source material, for example, softwood or hardwood. The fibers are arranged into a continuous sheet material or web by any known papermaking process, for example, by wet pressing or through-air-drying. The continuous web is rolled to a parent roll to await converting. Converting is the process whereby a parent roll of paper web is transformed into end products, for example, bath tissue, napkins, paper towels, and the like.

Converting encompasses many different potential operations on the paper web including, for example, cutting, folding, gluing, embossing, slitting, perforating, plying, grooving, punching, laminating, chemically treating, and the like. Specific combinations of converting operations are well understood to produce certain end products, for example, paper towel rolls, napkins, facial tissue, etc. Without disclosing all such combinations and operations herein, the skilled artisan will understand the application of the disclosed technique in any art recognized converting operation.

During converting operations, the paper web may be transferred one or more times between various rolls that move the paper web through the various converting operations. For example, the paper web may be unwound from one roll and passed between a pair of embossing rolls before being rewound onto another roll.

SUMMARY OF THE INVENTION

Described herein is a core-roll and a method for making a core-roll having anti-slip characteristics that enhance the grip of the paper to the roll. According to one embodiment, the method includes treating the surface of the core-roll, which may be a parent roll or another converting roll, to provide anti-slip zones. The core-rolls of the present disclosure prevent the need for rings or other anchors to prevent lateral movement of the paper roll, thereby improving the amount of paper product that can be removed from the parent roll during conversion without damage.

A better understanding of the various disclosed system and method embodiments can be obtained when the following detailed description is considered in conjunction with the drawings.

DETAILED DESCRIPTION

Figure 1:
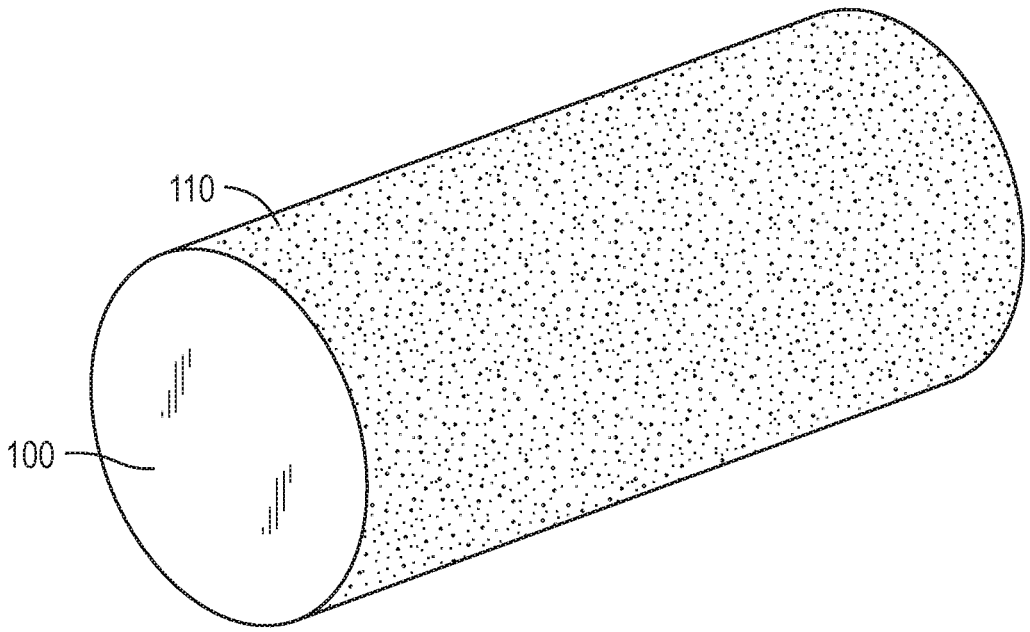
FIG. 1 is a core-roll according to one embodiment of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

The present description relates to a core-roll for use as the center of a paper roll that includes non-slip characteristics. In one embodiment, the present disclosure relates to a parent-roll core that removes the need for alternative hardware to prevent the paper roll from slipping off or along the core. In another embodiment, the present disclosure provides a coated core-roll that enhances the grip of the paper to the roll and further prevents slippage of the paper web along the core. In yet another embodiment, the present disclosure provides a method for making the anti-slip core-roll so that the anti-slip zones on the core-roll will not interfere with the normal transfer of the paper web off the parent-core-roll and through the converting operations.

Certain terms are used throughout the following description and claims to refer to particular features or components. As one skilled in the art will appreciate, different persons may refer to the same feature or component by different names. This document does not intend to distinguish between components or features that differ in name but not structure or function.

In exemplary embodiments, methods and systems are provided for converting paper webs to end products. As used herein, the terms "core," and "core-roll" are understood to be interchangeable except where specifically indicated as different or where one of ordinary skill in the art would understand them to be different, and refer to a roll that forms the center, or spindle, upon which a paper web is wound.

As used in the following discussion and in the claims, the terms "including," "comprising," "containing," etc. are used in an open-ended fashion, and thus should be interpreted to mean "including, but not limited to." If closed language is included, "consisting," and "consisting essentially of," it will be given its art recognized meaning.

As used herein "paper web," "continuous paper web," "paper roll," "rolled paper" and "paper" are interchangeable and refer to the paper web that is being wound about the core-roll.

As used herein "substantially in-place" means that the lateral movement of the paper along the core is within commercially acceptable limits. Commercially acceptable limits can differ, but according to one embodiment, the paper moves laterally less than 1 inch, for example, less than 0.75 inches, for example, less than 0.5 inches, for example, less than 0.25 inches. Lateral shift is calculated by measuring the smallest distance between the paper roll and the end of the core roll before the paper is unwound and measuring the smallest distance between the paper and the end of the core when the remaining paper on the roll reaches 2 inches from the core surface, and subtracting the distance after unwinding from the distance before unwinding. In a typical 125 inch diameter paper roll, the measures would be made at 125 inches and again when the roll diameter reaches 2 inches.

As used herein "non-slip," "anti-slip," and "grip" are interchangeable and do not refer to absolute conditions. They refer to the characteristic of holding the rolled paper substantially-in-place.

As used herein, the "zone" and "anti-slip zone" are interchangeable and refer to the surface of the core-roll that has been treated to render it anti-slip. Zone can include treatment of the complete roll, as well as, treatment of smaller, continuous or discontinuous areas. The anti-slip zone can refer both to the removal of material as well as the addition of material. Added material may be applied to the surface of a finished core-roll, or may be incorporated into a core-roll during production. Removed material includes material removed from the surface of the roll by an after performed operation like chemical etching. Removed material also includes material that is purposefully left out during roll production to create areas with a higher coefficient of friction, for example, the surface of the core being molded or cured against a substrate that causes voids or alterations in the core material located below the surface of the core.

In exemplary embodiments, the instant disclosure provides a cylinder that forms the core-roll upon which paper is wound after its formation or during its conversion to end products. The cylinder for use in the instant invention may be made of an art recognized material for forming parent or converting rolls. According to one embodiment, the cylindrical core may be made from appropriate metals and hard polymers, including but not limited to stainless steel or rubber.

The core-roll may be rendered anti-slip by creating zones on the roll that have a higher coefficient of friction than the remainder of the roll. These zones help to anchor the paper web to the core-roll thereby minimizing lateral shifting of the rolled paper on the core. Anti-slip zones can be created either by removing material to create an area in which the coefficient of friction has been raised or by applying an anti-slip material to the core-roll. Other known or after-developed methods for modifying the coefficient of friction of the core-roll surface are contemplated herein and will be understood by the skilled artisan. If the core-roll is a curable material, microspheres or particles may be added to the polymer to adjust the coefficient of friction in the entire roll or in various zones.

In one embodiment, the core-roll may be rendered anti-slip by applying to the cylindrical core an anti-slip material. Materials for rendering the core non-slip would have a coefficient of friction that would inhibit movement of the paper sheet on the roll. Materials that have suitable coefficients of friction and that can be used to create anti-slip zones on the core-roll include one or more of polyurethanes, polyureas, polyethylenes, acrylic latexes, ethylene acetates, rubbers, including thermoplastic rubbers, isocyanates, and polyolefins. The anti-slip material may be the proprietary polyurethane-rubber coating marketing under the tradename HERCULINER by Old World Industries, LLC., a polyurethane-polyurea coating marketed under the tradename RHINOLINER, a polyurethane-polyurea coating marketed under the tradename LINE-X, or an epoxy coating marketed under the name GATOR GUARD. According to one embodiment, the anti-slip material is the coating marketing under the tradename HERCULINER.

According to another embodiment, the core may be rendered anti-slip by subjecting the roll to a process such as sanding, abrading, grinding, etching, or the like.

According to one embodiment, the anti-slip zone extends the entire surface of the core-roll. According to another embodiment, the anti-slip zone extends around the circumference of the core-roll but does not cover the entire surface. According to one embodiment, the anti-slip zone includes all but an area along the outside edges of the core-roll. According to one embodiment, the edge portions of the core-roll that may be free from the anti-slip materials can be from about 4 to about 15 inches, as measured from the end of the roll inward toward the center, for example from about 4 inches to about 10 inches, for example from about 6 to 8 inches.

According to another embodiment, the center of the core-roll may include an area that is free from anti-slip material. According to one embodiment, this center area may extend from about 20 to about 70 inches, including all sub-ranges, for example, about 30 inches, for example about 40 inches, for example about 50 inches, for example about 60 inches. According to one embodiment, the center area free from anti-slip material is oriented across the center line of the roll with an equal distance of the core being free from anti-slip material on each side. According to another embodiment, the center area free from anti-slip material can be moved laterally away from the center line in either direction as would be desired by the skilled artisan.

According to yet another embodiment, the core-roll is provided with anti-slip material everywhere except in an area in the center of the core-roll and in areas along both outside edges of the core-roll. In one embodiment, the anti-slip material is applied to the entire core-roll, except for about 30 inches in the center of the roll and about 6 to 8 inches along the edges. In this embodiment, the core-roll will have two continuous or discontinuous bands of anti-slip material. As will be understood by the skilled artisan, the above coverage areas are merely exemplary and the anti-slip material may be placed on the roll in any pattern or regional arrangement that achieves sufficient non-lateral movement of the paper rolled on the core. According to one embodiment, the anti-slip material is applied to at least 30 inches of a 120 inch roll, for example, at least 40 inches, for example at least 50 inches. While this embodiment contemplates that the anti-slip material will span the entire circumference of the core roll, it is not necessary and the areas can be segmented.

The thickness of the coating is not important and should merely be enough to modify the friction coefficient while avoiding interference with the surrounding processes. According to one embodiment, the coating may be applied from about 20 lbs/rm to about 100 lbs/rm, more particularly, from about 50 lbs/rm to about 75 lbs/rm.

The core-roll may be treated by applying a coating of the anti-slip material to the core-roll using any art recognized method. According to one embodiment, the anti-slip material is applied to the core-roll using a brush or sprayer and allowed to dry or cure. According to another embodiment the roll is rotated in a receptacle whereby the anti-slip material may be applied to the surface of the core-roll either along its entire length or in zones. The core-roll would also then be allowed to dry or cure depending upon the nature of the anti-slip material that is applied. The anti-slip material may be solvent based or it may be water based.

As discussed above, the anti-slip material may be applied to the entire core-roll or may be applied to one or more areas of the core-roll to minimize interference between the anti-slip material and other equipment or sensors that are used in the converting process. The embodiments described below in relation to the figures are merely exemplary and other configurations are contemplated herein and may be used.

FIG. 1 is a representation of a core-roll according to the present disclosure. In the embodiment shown, the core-roll 100 is surrounded by the anti-slip material 110. In this embodiment, the anti-slip material is present on the entire circumference of the core.

Figure 2:
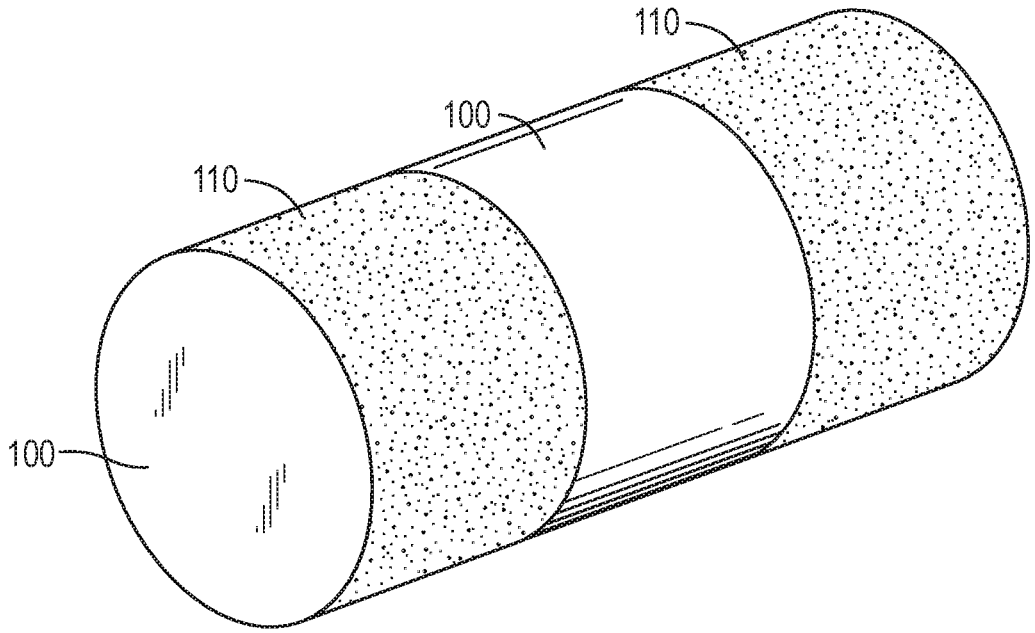
FIG. 2 is a core-roll according to another embodiment of the present disclosure.

FIG. 2 is also a representation of a core-roll according to the present disclosure. In the embodiment shown, the core-roll 100 is again surrounded by the anti-slip material 110. In this embodiment, the anti-slip material is absent from the center of the core-roll. This embodiment provides no anti-slip zone in an area where the core-roll is expected to be lifted for repositioning.

Figure 3:
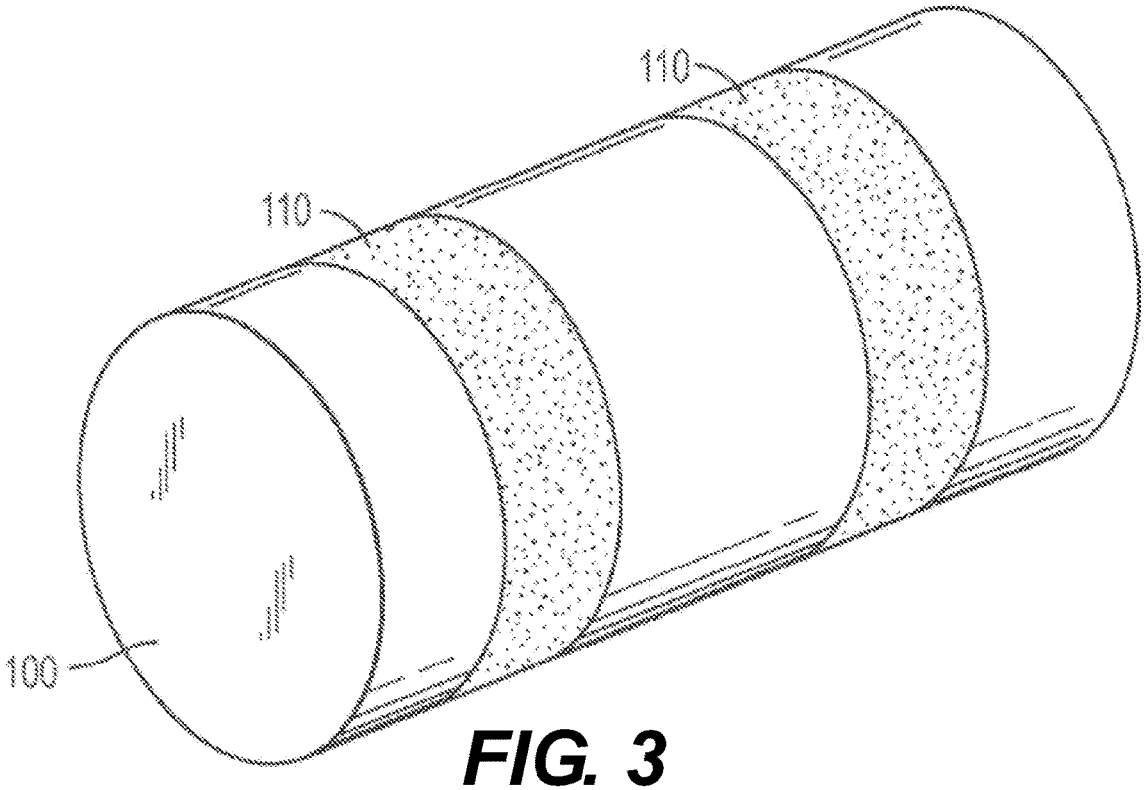
FIG. 3 is a core-roll according to yet another embodiment of the present disclosure.

FIG. 3 is also a representation of a core-roll according to the present disclosure. In the embodiment shown, the core-roll 100 is again surrounded by the anti-slip material 110. In this embodiment, the anti-slip material is absent from both the center of the core-roll and the ends of the core-roll. This embodiment provides anti-slip characteristics without interfering with either the repositioning of the cores or the sensors or other equipment that can be used in the downstream converting process.

Figure 4:
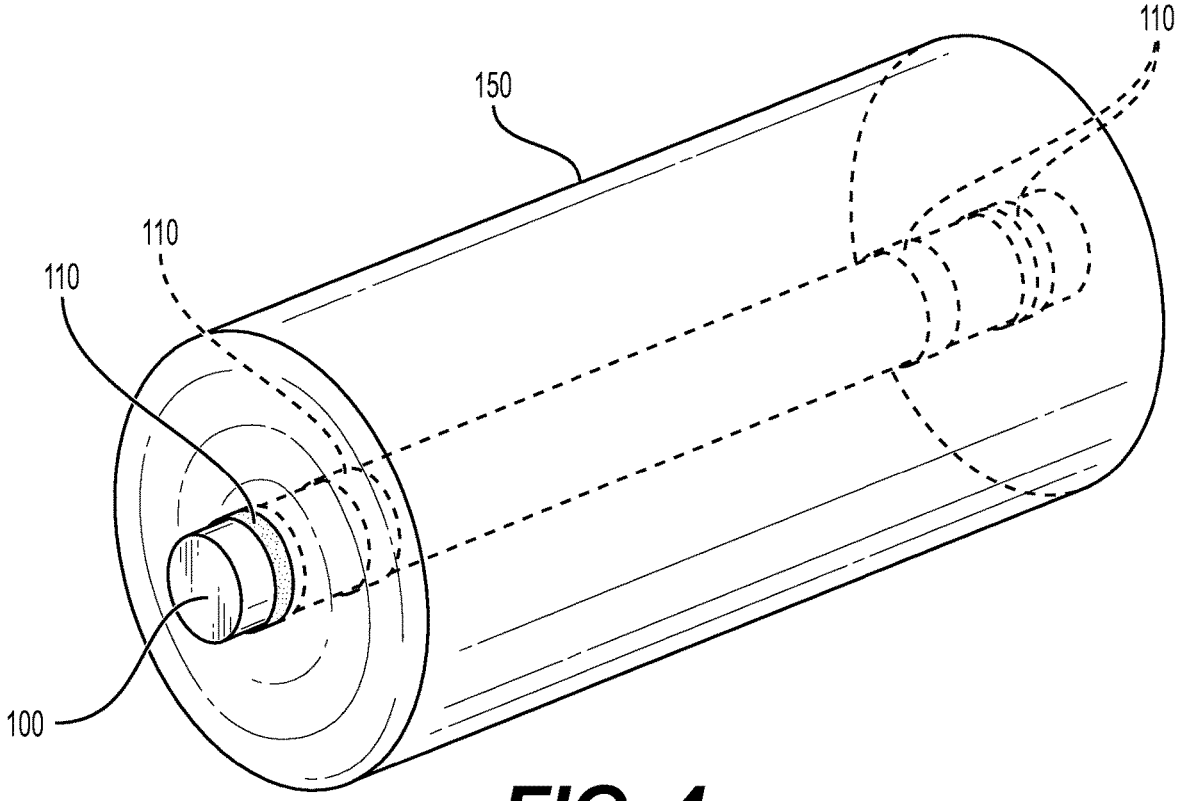
FIG. 4 is a paper roll around a core-roll according to one embodiment of the present disclosure.

FIG. 4 is a representation of a roll of paper 150 upon a core-roll according to the present disclosure. In the embodiment shown, the core-roll 100 is again surrounded by the anti-slip material 110. In this embodiment, the anti-slip material is provided in ringed areas.

Figure 5:
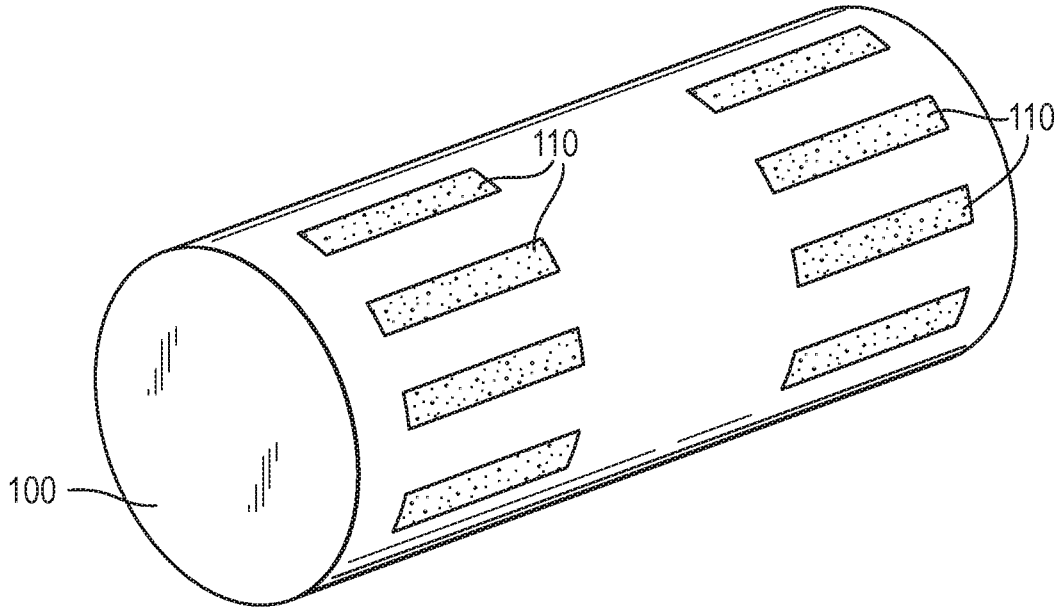
FIG. 5 is a core-roll according to yet another embodiment of the present disclosure.

FIG. 5 is a representation of a core-roll according the present disclosure. In the embodiment shown, the core-roll 100 is provided with areas of anti-slip material 110. As represented, these areas are discrete and may or may not traverse the entire circumference of the core-roll.

As can be seen from the various embodiments, the anti-slip material may be located in one or more areas on the core-roll. The location and shape of the anti-slip material is generally aligned with the way in which the core-roll will be moved and used during the converting operation. A myriad of possible configurations will be readily apparent to the skilled artisan.

According to one embodiment, the anti-slip material may extend beyond the edges of the paper web that is rolled onto the core-roll. One representation of this can be seen in FIG. 4.

Example

Using a Thwing-Albert 225-1, Friction/Peel tester, a coefficient of friction was measured for an anti-slip core according to the present disclosure. The procedure of ASTM D1894 was used. The instrument set up included a 200 gram sled, a pull speed of 6 in/min and times of T1—5 seconds, T2—5 seconds, and T3—20 seconds.

The untreated core material was attached to the sled and pulled across a piece of the untreated core material. Likewise, a piece of treated core material was attached to the sled and pulled across a piece of treated core material. The results are set forth in Table 1, below.

TABLE 1

COEFFICIENT OF FRICTION

| Sample | STATIC | KINETIC |
|---|---|---|
| Untreated/Untreated | 0.413 | 0.305 |
| | 0.353 | 0.287 |
| | 0.380 | 0.285 |
| Average: | 0.382 | 0.292 |
| SD: | 0.030 | 0.011 |
| Treated/Treated | 1.524 | 0.977 |
| | 1.142 | 0.824 |
| | 1.401 | 0.831 |
| Average: | 1.356 | 0.877 |
| SD: | 0.195 | 0.086 |

The results above show that the untreated core material has a static coefficient of friction of 0.382±0.03 while the treated core material has a static coefficient of friction of 1.356±0.195. The static friction of the treated materials is 3.5 times the friction of the untreated core material. The static coefficient of friction refers to the amount of force between the two objects. A force equal to the static friction will be required to move the objects relative to one another. The kinetic friction by contrast is the amount of friction between two objects while they are moving. A force equal to the kinetic friction is necessary to keep the two objects moving at a constant speed.

According to one embodiment, the treated roll has a coefficient of static friction above the coefficient of static friction for the untreated roll and the increase in friction holds the paper web substantially-in-place. According to one embodiment, the core material exhibits a coefficient of static friction that is at least twice the coefficient of static friction of the untreated core. According to another embodiment, the core material exhibits a coefficient of static friction that is at least three times the coefficient of static friction of the untreated core.

Other embodiments of the present invention can include alternative variations. These and other variations and modifications will become apparent to those skilled in the art once the above disclosure is fully appreciated. It is intended that the following claims be interpreted to embrace all such variations and modifications.

What is claimed is:

1. A cylinder that forms a core-roll for holding a continuous paper web having a first end and a second end, the core-roll minimizing lateral movement of that paper web during its conversion to end products, comprising:

a roll cylinder of one or more metals and/or hard polymers, having a surface, a first edge and a second edge, the surface of the roll cylinder comprising at least two zones that have a static coefficient of friction greater than the static coefficient of friction of the material from which the surface of the roll cylinder is made, wherein at least one first zone is located proximate but not coextensive with the first edge of the roll cylinder and wherein the first zone begins between the first edge of the roll cylinder and the first end of the paper web and extends beneath the paper web; and wherein at least one second zone is located proximate but not coextensive with the second edge of the roll cylinder and wherein the second zone begins between the second edge of the roll cylinder and the second end of the paper web and extends beneath the paper web.

2. The core-roll of claim 1, wherein a paper web wound about the core-roll will remain substantially in-place.

3. The core-roll of claim 1, wherein the coefficient of friction in the zones is at least twice the coefficient of friction of the material from which the roll cylinder is made.

4. The core-roll of claim 1, wherein the coefficient of friction in the zones is at least three times the coefficient of friction of the material from which the roll cylinder is made.

5. The core-roll of claim 1, wherein the zones are created by applying an anti-slip material.

6. The core-roll of claim 5, wherein the anti-slip material is a chosen from one or more of polyethylenes, ethylene acetates, rubbers, including thermoplastic rubbers, isocyanates, and polyolefins.

7. The core-roll of claim 6, wherein the anti-slip material does not extend all the way to the outside edges of the core-roll.

8. The core-roll of claim 6, wherein the anti-slip material does not extend across the center of the core-roll.

9. The core-roll of claim 8, wherein the anti-slip material is chosen from polyurethane rubbers.

10. The core-roll of claim 5, wherein the anti-slip material does not extend all the way to the outside edges of the core-roll.

11. The core-roll of claim 5, wherein the anti-slip material is chosen from polyurethane rubbers.

12. A parent roll for use in the production of paper products comprising:

a core-roll of one or more metals and/or hard polymers and a paper web surrounding the core-roll, wherein the paper web has two edges and wherein the core-roll comprises at least two zones created by applying an anti-slip material to the surface of the core-roll wherein the zones of anti-slip material are positioned so as to extend beyond the two edges of the paper web thereby minimizing lateral movement of a paper web.

13. The parent roll of claim 12, wherein the anti-slip material is a chosen from one or more of polyethylenes, ethylene acetates, rubbers, including thermoplastic rubbers, isocyanates, and polyolefins.

14. The parent roll of claim 12, wherein the paper web surrounding the core-roll remains substantially-in-place.

15. The parent roll of claim 13, wherein the anti-slip material does not extend across the center of the core-roll.

16. The parent roll of claim 13, wherein the anti-slip material is chosen from polyurethane rubbers.

17. The parent roll of claim 13, wherein the anti-slip zones are located on the core-roll where they do not interfere with subsequent converting operations.

* * * * *